US009993063B2

(12) United States Patent
Nowak et al.

(10) Patent No.: US 9,993,063 B2
(45) Date of Patent: Jun. 12, 2018

(54) IDENTIFICATION BADGE HOLDING SYSTEM

(71) Applicant: Infinifan, Inc., Deer Park, NY (US)

(72) Inventors: Cheri Nowak, Deer Park, NY (US); David Calnan, Deer Park, NY (US)

(73) Assignee: Infinifan, Inc., Deer Park, NY (US)

( * ) Notice: Subject to any disclaimer, the term of this patent is extended or adjusted under 35 U.S.C. 154(b) by 0 days. days.

(21) Appl. No.: 15/335,935

(22) Filed: Oct. 27, 2016

(65) Prior Publication Data

US 2017/0112268 A1 Apr. 27, 2017

Related U.S. Application Data

(60) Provisional application No. 62/247,075, filed on Oct. 27, 2015.

(51) Int. Cl.
*A45F 5/00* (2006.01)
*A44C 3/00* (2006.01)

(52) U.S. Cl.
CPC ..... *A45F 5/00* (2013.01); *A44C 3/001* (2013.01); *A45F 2005/006* (2013.01);
(Continued)

(58) Field of Classification Search
CPC . Y10T 24/1391; Y10T 24/44453; A44C 1/00; A44C 3/001; A45F 5/00;
(Continued)

(56) References Cited

U.S. PATENT DOCUMENTS 2,328,206 A 8/1943 Fowler
3,054,201 A 9/1962 Burns
(Continued)

FOREIGN PATENT DOCUMENTS

JP 2001-078874 A 3/2001
WO 1994/08483 A1 4/1994
(Continued)

OTHER PUBLICATIONS

"Little Boy in Bowtie Badge Reel, Dressed Up Boy ID Holder, Girl in Pigtails Badge Reel, Applique, Magnet, Inspired by Caleb and Sophie," Etsy, etsy.com, HollyCraftOriginals, accessed: Sep. 2016. See https://www.etsy.com'listing/266894957/little-boy-in-bowtie-badge-reeldressed/ref=market discloses an ornamental badge reel.
(Continued)

*Primary Examiner* — Abigail E Troy
(74) *Attorney, Agent, or Firm* — Fox Rothschild LLP; Robert J. Sacco; Carol E. Thorstad-Forsyth

(57) ABSTRACT

An identification badge holder includes a character body that has a front and back side. The front side of the character body includes a face of an animal character, a humanoid or a licensed entity. The back side of the character body is attached to a spring loaded clip. The spring loaded clip has two arms that are hinged at a middle section, with one arm being permanently fixed to the back side of the character body and the other arm movable relative to the fixed arm so that the clip can open and close. This operation allows the spring loaded clip to attach to or release from an identification badge such as a convention or trade show badge. One of the arms also has a slot at an end for attaching to a lanyard clip.

8 Claims, 6 Drawing Sheets

(52) U.S. Cl.
CPC ..... *A45F 2200/055* (2013.01); *Y10T 24/1391* (2015.01); *Y10T 24/44453* (2015.01)

(58) Field of Classification Search
CPC ..... A45F 2005/002; A45F 2005/006; A45F 2200/05; A45F 2200/055
USPC ..... 132/275–277; 63/40
See application file for complete search history.

(56) References Cited

U.S. PATENT DOCUMENTS

| | | | | |
|---|---|---|---|---|
| 3,583,085 | A | 6/1971 | Klitzner | |
| 4,261,121 | A * | 4/1981 | Coon | A47G 25/485 223/96 |
| D315,118 | S | 3/1991 | Davison et al. | |
| 5,826,606 | A | 10/1998 | Davenport | |
| 6,085,393 | A | 7/2000 | Tsui et al. | |
| D469,248 | S | 1/2003 | Fritsche | |
| 7,007,882 | B2 | 3/2006 | Raia et al. | |
| 7,086,123 | B2 * | 8/2006 | Carter | A41F 17/02 24/72.1 |
| 7,380,357 | B2 | 6/2008 | Jones et al. | |
| 7,587,844 | B1 | 9/2009 | Palmer | |
| D623,176 | S | 9/2010 | Canchola | |
| D695,514 | S | 12/2013 | Young | |
| D697,304 | S | 1/2014 | Westfall | |
| D724,477 | S | 3/2015 | Weinshanker | |
| D742,764 | S | 11/2015 | Steib | |
| 2008/0250678 | A1 | 10/2008 | Kresser et al. | |
| 2009/0007466 | A1 | 1/2009 | Sahud | |
| 2014/0044910 | A1 | 2/2014 | Shi | |
| 2015/0089975 | A1 | 4/2015 | Paleschuck et al. | |
| 2015/0223588 | A1 | 8/2015 | DeNittis et al. | |

FOREIGN PATENT DOCUMENTS

| | | |
|---|---|---|
| WO | 2003/026456 | 4/2003 |
| WO | 2015/123649 A1 | 8/2015 |

OTHER PUBLICATIONS

"Bioworld Badge Holders EPC & Barcode," UpcItemDb, upcitemdb.com, accessed: Sep. 2016. See http:www.upcitemdb.com/info-bioworld badge-holders discloses licensed badge holder lanyards.

* cited by examiner

IDENTIFICATION BADGE HOLDING SYSTEM

CROSS-REFERENCE TO RELATED APPLICATIONS

This patent application claims priority to U.S. Provisional Patent Application No. 62/247,075 filed Oct. 27, 2015, the disclosure of which is incorporated herein by reference in full.

FIELD OF THE INVENTION

This disclosure relates to the field of badge holders and particularly to badge holders with characters.

BACKGROUND OF THE INVENTION

The following references appear to be possibly relevant to identification badge related holding devices: U.S. Pat. No. 7,380,357 [Jones et al] discloses a promotional badge holder that includes an intermediate swiveling ornamental portion (second housing in docking relationship with first housing) U.S. Pat. No. 7,007,882 [Raia et al] discloses a retractable badge reel, comprising: a case; a securing unit which is capable of attachment to an article which is to be held by the badge reel, the securing unit being connected to an extendable and automatically retracting cord housed inside the case; and a billboard that fits over the front of the case; wherein the billboard has a front face adapted to display a logo.

U.S. Published Patent Application No. 2014/0044910 [Shi] discloses a system for attaching an external object to a cloth, the system comprising: a badge; a first attachment, wherein the attachment is configured to releasably attach a cloth to the badge; and a second attachment, wherein the second attachment is configured to releasably attach a decoration to the badge. U.S. Published Patent Application No. 2009/0007466 [Sahud] discloses an I.D. badge holder a first portion; a second portion which detachably connects with the first portion; a first tile attached to the first portion having a clamp assembly that fixes to an object; and a second tile attached to the second portion which holds the ID badge.

International Patent Application No. WO 2003026456A1 discloses an ornament for decorating a button. U.S. Pat. No. D724,477 [Weinshanker] discloses a cable accessory. International Patent Application No. WO 9408483A1[Van] discloses a badge (1) suitable for use by children, comprising a backing member (2) to which a three-dimensional display element (3) can be releasably secured.

The following non-patent literature articles were also identified as possibly relevant: "Little Boy in Bowtie Badge Reel, Dressed Up Boy ID Holder, Girl in Pigtails Badge Reel, Applique, Magnet, Inspired by Caleb and Sophia," Etsy, etsy.com, HollyCraftOriginals, accessed: September 2016. See https://www.etsy.com/listing/266894957/little-boy-in-bowtie-badge-reeldressed/ref=market discloses an ornamental badge reel.

"Bioworld Badge Holders UPC & Barcode," UpcItemDb, upcitemdb.com, accessed: September 2016. See http://www.upcitemdb.com/info-bioworld_badge-holders discloses licensed badge holder lanyards.

The total following U.S. references were thought to be relevant: U.S. Pat. Nos. 7,380,357; 7,007,882; 6,085,393; 3,583,085; 3,054,201; 2,328,206; 5,823,606; 7,587,844; D 742,764; D 724,477; D 697,304; D 695,514; D 623,176; D 469,248; D 315,118; 2015/0223588; 2015/0089975; 2014/0044910; 2009/0007466; and 2008/0250678.

The following foreign references were also noted of interest: WO 2015123649A1; WO 2003026456A1; WO 9408483A1; and JP 2001078874A.

In summary, none of the foregoing prior art appear to disclose or suggest an easy to use, easy to make and totally secure badge holder as further disclosed herein.

SUMMARY OF THE INVENTION

An identification badge holder is attachable to an identification badge having an aperture therein, such as a convention or trade show badge, and also attachable to a lanyard having a clip connected thereto. The holder includes a character body having a front and back side, and a spring loaded clip, which has a first arm that is permanently attached to the back side of the character body via a pin, and a second arm that is hinged to the first arm by a hinge pin in a middle section. Each of the first and second arms has a tip and the tips of the two arms together meet at a gripping end for attachment through an aperture in the identification badge. In forming the gripping end, both the first and second arms have tips which are curved inward and facing each other, and overlap each other when the spring loaded clip is in a relaxed state.

Additionally, the second arm has a slot on a distal end opposite the curved tip for attaching the lanyard clip to the identification badge holder, wherein the slot is an aperture in an oblong shape and sufficiently big enough so that the curved tips of the lanyard clip can pass though the oblong aperture and securely hold the identification badge.

The front side of the character body includes the face of an animal character, a humanoid or a licensed entity.

These and other features of the invention may be more fully understood by reference to the following drawings.

DETAILED DESCRIPTION

This disclosure is not limited to the particular devices, methodologies or protocols described, as these may vary. The terminology used in this description is for the purpose of describing the particular versions or embodiments only, and is not intended to limit the scope.

Figure 1A:
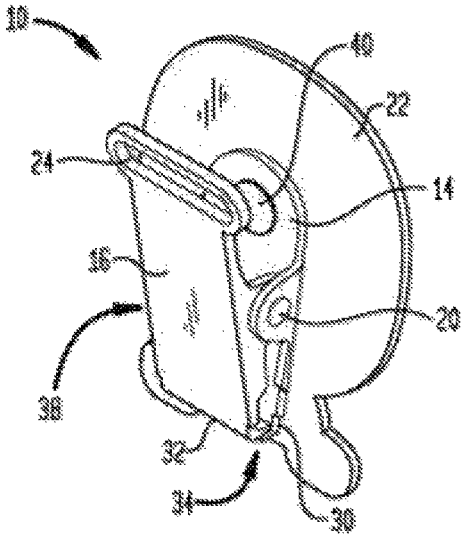
FIG. 1A is a rear perspective view of the identification badge holder according to a first embodiment.
Figure 1B:
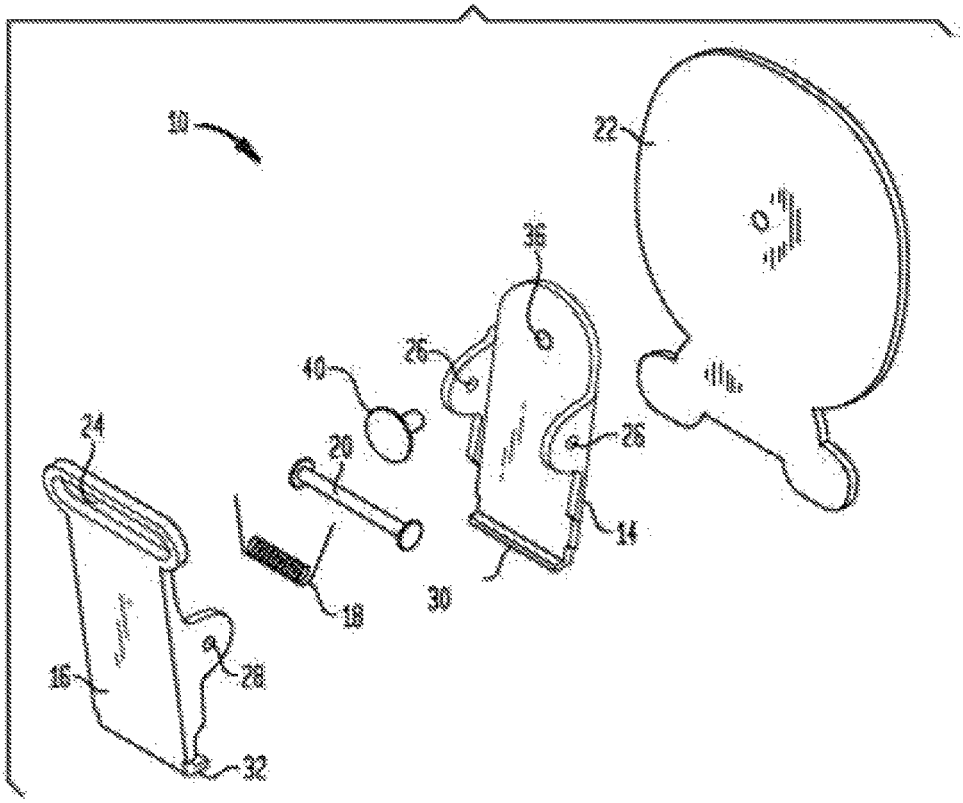
FIG. 1B is an exploded view of the identification badge holder illustrated in FIG. 1A.

In a preferred embodiment shown in FIGS. 1A and 1B, an identification badge holder 10 for attaching to an identification badge includes a character body 22 and a spring loaded clip 38 permanently attached to the back of the character body 22, where the spring loaded clip 38 has two arms 14, 16 that are attached by a hinge pin 20 in a middle section.

There can be various ways to attach the two arms by a hinge. In the illustrated embodiment, each arm can be a metal plate having two side leafs in a middle section that bend inward towards each other and perpendicularly to the metal plate, the bended portions of the two side leafs each has a hinge hole 26 that together will allow the hinge pin 20 to go through to facilitate a hinge. The spring loaded clip 38 also has a spring 18 secured between the two arms 14, 16, where the spring 18 is a traditional spring for use with a clip. In FIG. 1B, the spring 18 has a spiral core that aligns with the two hinge holes 26 of each arm and receives the hinge pin 20 through the spiral core. This arrangement causes the spring loaded clip 38 to be in one of the two positions: a relaxed position and a clipping position.

FIG. 1A shows the spring loaded clip in a relaxed position. Each of the two arms 14, 16 has a tip 30, 32 that are curved inward and face each other, and the curved tips overlap each other to form a gripping end 34 when the spring loaded clip is in a relaxed state. This gripping end 34 can go through a slot of an identification badge, such as a convention badge, to facilitate attachment of the spring loaded clip to the identification badge. When a user presses one or two arms 14, 16 inward at a distal point from the gripping end 34, the spring loaded clip 38 will reach a clipping position with the gripping end 34 being forcibly open, so that the identification badge that attaches to the gripping end 34 can be released.

In the illustrated embodiment, the spring loaded clip 38 is attached to the back of the character body 22 by one of its arms. For example, the first arm 14 is permanently attached to the back of the character body via a pin 40, which provides a pivot point where the clip attaches to the back of the character body 22. This pivot point allows the front of the character body 22 to be turned around 360 degrees for better positioning when the badge holder 10 is attached to an identification badge, such as a convention badge, or an article. The second arm 16 has a slot 24 on a distal end for attaching the identification badge holder 10 to another clip e.g. a lanyard clip, as will be further described in FIG. 2. Specifically, the slot 24 can be an aperture having an oblong shape that is sufficiently big enough so that a gripping end of the lanyard clip (46 in FIG. 2) can pass through the oblong aperture 24 and securely hold the identification badge holder 10.

Figure 2:
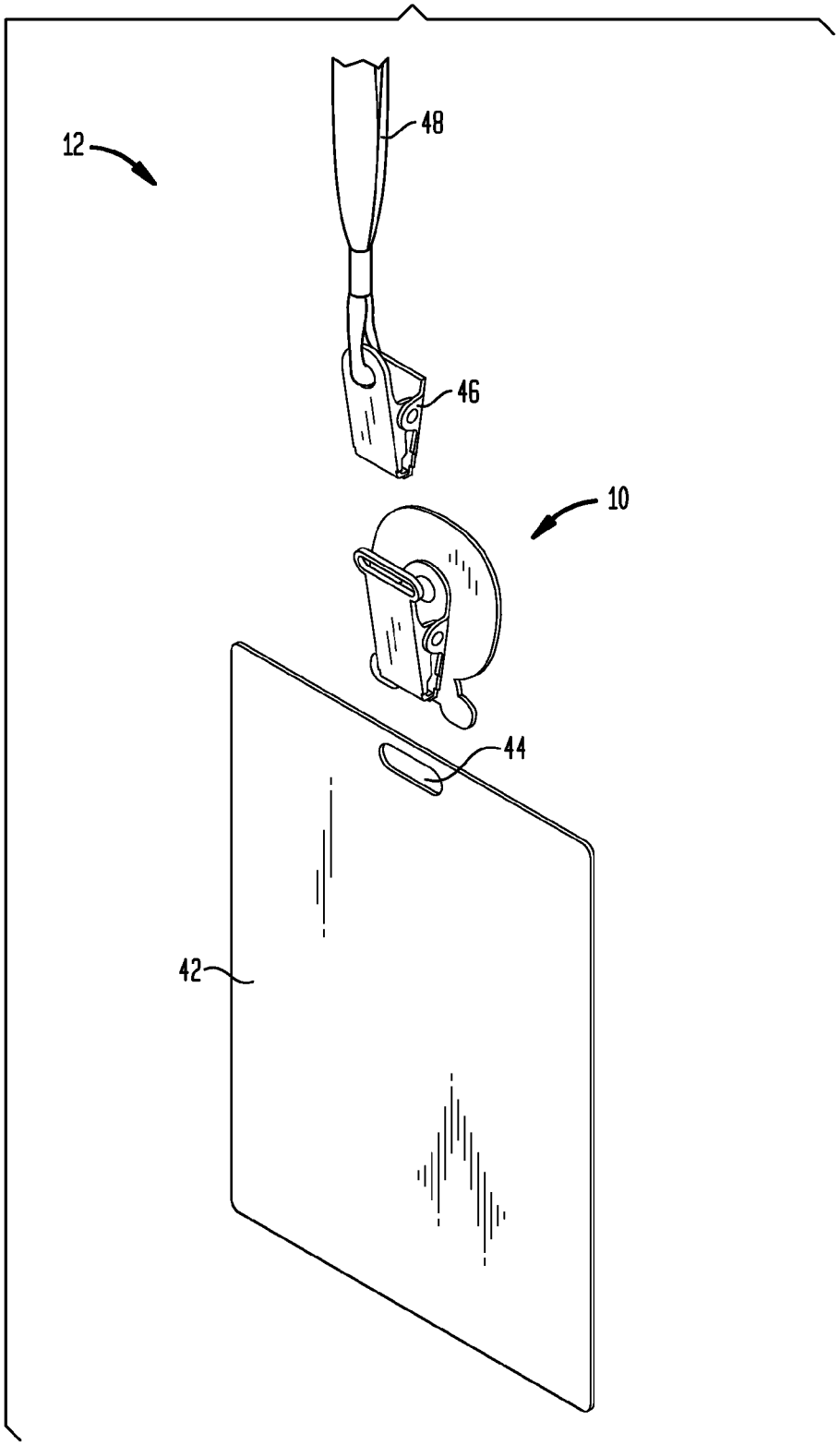
FIG. 2 is a combined badge holder according to the first embodiment.
Figure 3:
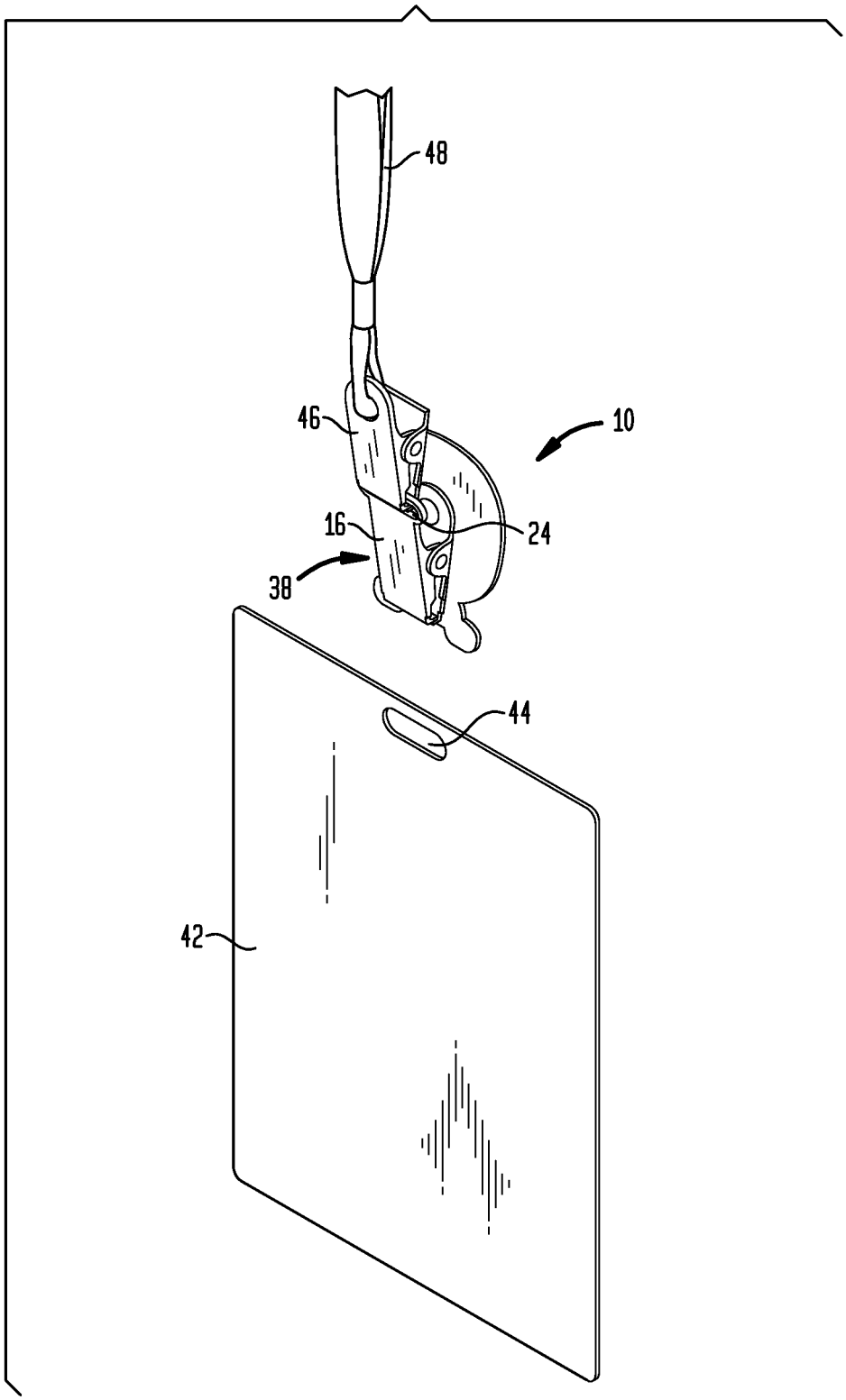
FIG. 3 illustrates the lanyard clip attaching to the identification badge holder.

FIG. 2 shows a combined badge holder 12 that includes a lanyard 48 attached to a conventional clip 46, the identification badge holder 10 and an identification badge 42 having a slot 44 for attachment, such as a convention or trade show badge. As demonstrated in FIG. 3, a method for using the identification badge holder 10 may include attaching the clip 46 of the lanyard 48 to the spring loaded clip 38 on the back of the character body 22. Particularly, the lanyard clip 46 is also a spring loaded clip that has a gripping end, which can grip the spring loaded clip 38 on the back of the character body 22 through slot 24 on the second arm 16 of the clip 38. In a similar manner, other types of clips such as an alligator clip, bulldog or J-hook/trigger snap clip hardware can also be attached to the clip 38 on the back of the character body through slot 24.

Figure 4:
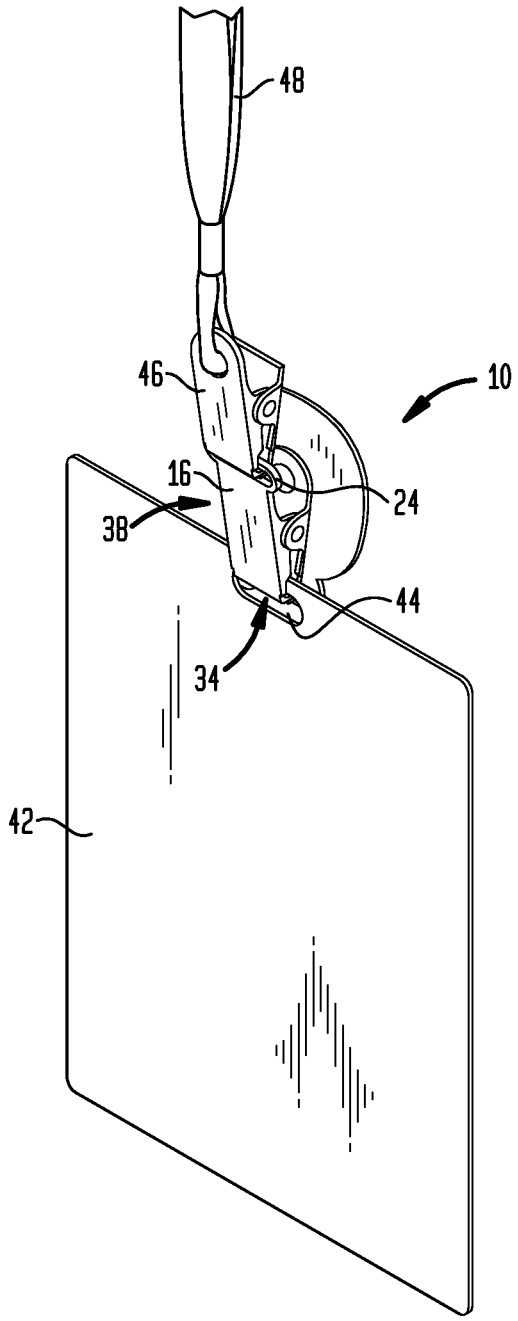
FIG. 4 illustrates the lanyard clip attaching to the identification badge holder, which attaches to an identification badge.

Next, in FIG. 4, the user may clip the attached lanyard 48 and the identification badge holder 10 to an identification badge 42 (such as a convention or trade show badge) by engaging the gripping end 34 of the clip 38 on the back of the character body 22 to the aperture 44 of the identification badge 42. Now, in FIG. 5, the identification badge holder 10 is attached to both the lanyard clip 46 and the identification badge 42, and the front of the character body 22 looks like it's peeking over and holding the badge.

Figure 5:
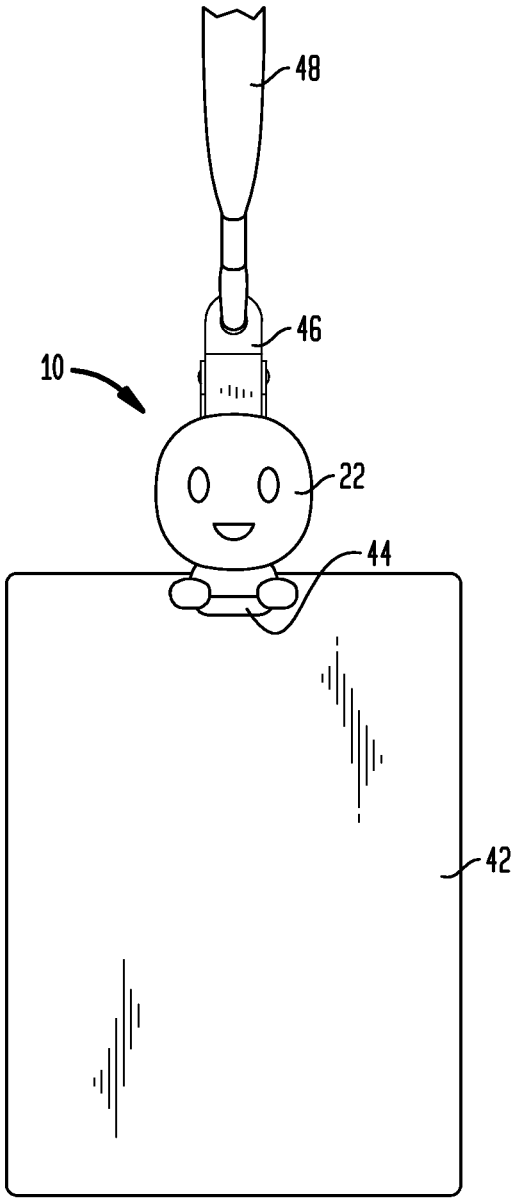
FIG. 5 illustrates the front view of the badge holder of FIG. 4.

Whereas character presented in FIG. 5 is a generic, common body shape to represent the similar proportions that can be presented throughout the illustrated embodiments, the character body can be variably constructed. For example, the front of the character body 22 can itself be a bas-relief sculpt, from the chest up, of a character with their hands up in a holding position to mimic holding onto the convention badge to which it is attached. The character body 22 may also variably include the face of an animal character, a humanoid or a licensed entity, such as different brands and characters e.g. Iron Man, The Hulk, Spider-Man, etc., for which the overall sculpt will change slightly to better represent the character.

Returning to FIG. 1A, in a non-limiting example, the character body 22 is a molded/painted plastic character with some dimension and the front of the character body 22 is measured a little over an inch, such as 1¼" to 1.5" in height, about 1.5" in width and about ¼" in depth. If the character body 22 is a bas-relief sculpt, it can be 0.3" to 0.4" in depth, e.g. 0.35", 0.36" or 0.38". In another non-limiting example, the spring loaded clip 38 on the back of the character body 22 can have a width narrower than the width of the character body 22, such as 0.4", 0.41" or 0.45". The width of the slot 24 on the spring loaded clip 38 for attaching to another clip can be of various width to accommodate common-type clips used for a badge. For example, the width of the slot can be between 0.5" and 0.7", such as 0.55", 0.58" and 0.6", and the height of the slot can also vary to accommodate common clips, for example, at ⅛".

Figure 6:
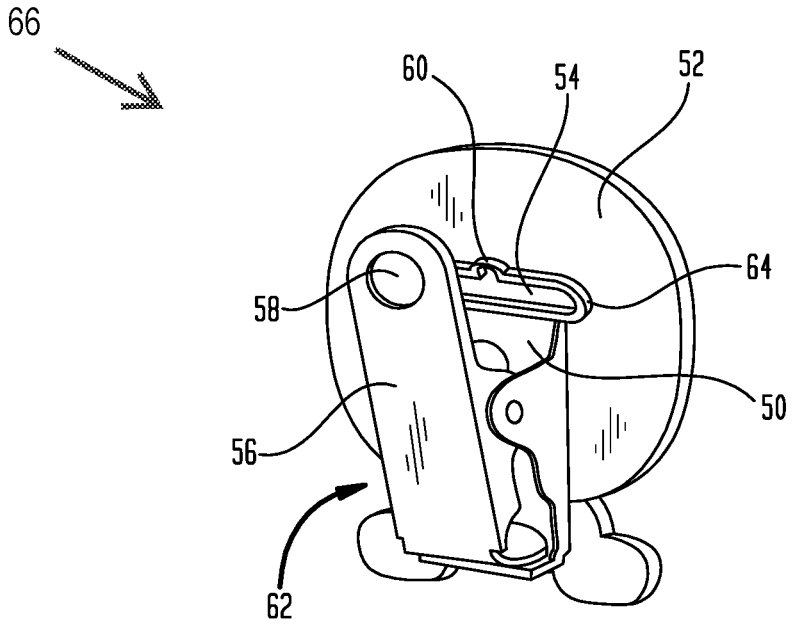
FIG. 6 is a rear perspective view of the identification badge holder according to a second embodiment.

In a second embodiment, as shown in FIG. 6, an identification badge holder 66 has a character body 52 and a spring loaded clip 62, which has a first arm 50 attached to the back of a character body 52, and the first arm 50 also has a slot 54 at a distal end portion 64 for attachment to the lanyard, where the distal end portion 64 is bent outward away from the back of the character body 52 to allow attachment of the lanyard clip through the slot 54. A second arm 56 of the spring loaded clip 62 may optionally have a circular aperture 58 for attaching a strap or lanyard. In another variation, the second arm 56 may also have an oblong aperture (not shown) for attaching to another clip.

Optionally, the slot 54 on the first arm 50 attached to the back of the character body 52 also has a notch 60 in the middle of the upper edge of the slot to accommodate attachment of lanyard or different types of lanyard clips (e.g. an alligator clip) and at the same time prevent the lanyard or lanyard clip from lateral movement along the edge of the slot 54. This will help keep the identification badge holder 66 straight while attached to a lanyard or lanyard clip. In another variation, the spring loaded clip 62 attached to the back of the character body 54 can also be of other types, such as a modified metal bulldog clip hardware.

The various embodiments disclosed in this patent document provide advantages over the prior art, whether standalone or combined. Particularly, the identification badge holder is easy to use, easy to make and can be securely attached to an identification badge, such as a convention or trade show badge, and a lanyard clip.

Other advantages of the present invention can be apparent to those skilled in the art from the foregoing specification. Accordingly, it be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

The invention claimed is:

1. An identification badge attachment apparatus for attaching an identification badge having an aperture therein to a lanyard having a clip connected thereto, said apparatus comprising:

a character body;

a spring loaded clip having a first arm attached to the character body and a second arm hingedly attached to the first arm by a hinge pin which together meet at a gripping end for attachment through the aperture in the identification badge; and, an oblong slot in the second arm of said spring loaded clip for attaching said lanyard clip to the spring loaded clip, wherein the oblong slot has a length longer than a width of the second arm.

2. The apparatus of claim 1 wherein the first and second arms of the spring loaded clip have tips which face each other and are curved inward and overlap each other when said spring loaded clip is in a relaxed state.

3. The apparatus of claim 2 wherein said oblong slot is distal from the gripping end.

4. The apparatus of claim 1 wherein the first arm of the spring loaded clip is attached to said character body by a pin.

5. The apparatus of claim 1 wherein the lanyard clip is spring loaded and has a first arm and a second arm which meet at a gripping end and tips of the first and second arms of the lanyard clip face each other and are curved inward and overlap each other when said lanyard clip is in a relaxed state.

6. The apparatus of claim 5 wherein the oblong slot in the second arm of said spring loaded clip is sufficiently big enough so that said curved tips of the lanyard clip can pass substantially through said oblong slot and securely hold the identification badge attachment apparatus.

7. The apparatus of claim 1 wherein said character body includes the face of an animal character, a humanoid or a licensed entity.

8. The apparatus of claim 1, wherein the identification badge comprises a convention or trade show badge.

* * * * *